US008062563B2

(12) United States Patent
Huber

(10) Patent No.: US 8,062,563 B2
(45) Date of Patent: Nov. 22, 2011

(54) METHOD OF MANUFACTURING EXPLOSIVES

(75) Inventor: Gerhard Huber, Rattenkirchen (DE)

(73) Assignee: Bowas AG für Industrieplanung, Zug (CH)

( * ) Notice: Subject to any disclaimer, the term of this patent is extended or adjusted under 35 U.S.C. 154(b) by 0 days.

(21) Appl. No.: 12/654,190

(22) Filed: Dec. 14, 2009

(65) Prior Publication Data

US 2011/0140293 A1 Jun. 16, 2011

(51) Int. Cl.
*C06B 21/00* (2006.01)

(52) U.S. Cl. ..... 264/3.1; 264/3.2; 264/140

(58) Field of Classification Search ..... 264/3.1, 264/3.2, 140
See application file for complete search history.

(56) References Cited

U.S. PATENT DOCUMENTS

| | | | | |
|---|---|---|---|---|
| 3,057,012 | A | 10/1962 | Lufkin | |
| 4,461,660 | A * | 7/1984 | Binet et al. | 149/2 |
| 4,920,079 | A | 4/1990 | Kaeser et al. | |
| 4,963,296 | A * | 10/1990 | Niedermeier et al. | 264/3.2 |
| 5,354,519 | A * | 10/1994 | Kaeser | 264/3.1 |
| 5,565,651 | A * | 10/1996 | Kim et al. | 264/3.1 X |
| 7,658,870 | B2 * | 2/2010 | Nejhad et al. | 252/511 |

FOREIGN PATENT DOCUMENTS

| | | | |
|---|---|---|---|
| DE | 1233310 | | 1/1967 |
| EP | 0084153 | A1 | 7/1983 |
| EP | 0296099 | | 12/1988 |
| WO | WO 8802743 | A1 | 4/1988 |
| WO | WO 03035580 | A2 | 5/2003 |

OTHER PUBLICATIONS

B.A. Bauer et al., "The Impact of Pressure, Temperature and Treatment Time on Starches: . . . ", Journal of Food Engineering, Jun. 1, 2005, pp. 329-334, vol. 68, Elsevier Ltd.

H. Eustina Oh et al., "Effect of High-Pressure Treatment on Normal Rice and Waxy Rice . . . ", Carbohydrate Polymers, Dec. 14, 2007, pp. 332-343, vol. 73, Elsevier Ltd.

Derek J. Crofton et al., "Dielectric Studies of Cellulose and Its Derivatives: 2. Effects of Pressure . . . ", Polymer, Oct. 1982, pp. 1609-1614, vol. 23, Butterworth and Co. Ltd.

R.E. Carter et al., "Extrusion Stresses, Die Swell, and Viscous Heating Effects . . . ", Jour. of Rheology, Feb. 1987, pp. 151-173, vol. 31, issue 2, John Wiley & Sons, Inc.

* cited by examiner

*Primary Examiner* — Leo B Tentoni
(74) *Attorney, Agent, or Firm* — Jean C. Edwards, Esq.; Edwards Neils PLLC

(57) ABSTRACT

A method of manufacturing explosives from a raw explosive material by gelatinizing the raw explosive, characterized in that the raw explosive is subjected to isostatic pressing prior to the gelatinization step.

21 Claims, 1 Drawing Sheet

FIGURE
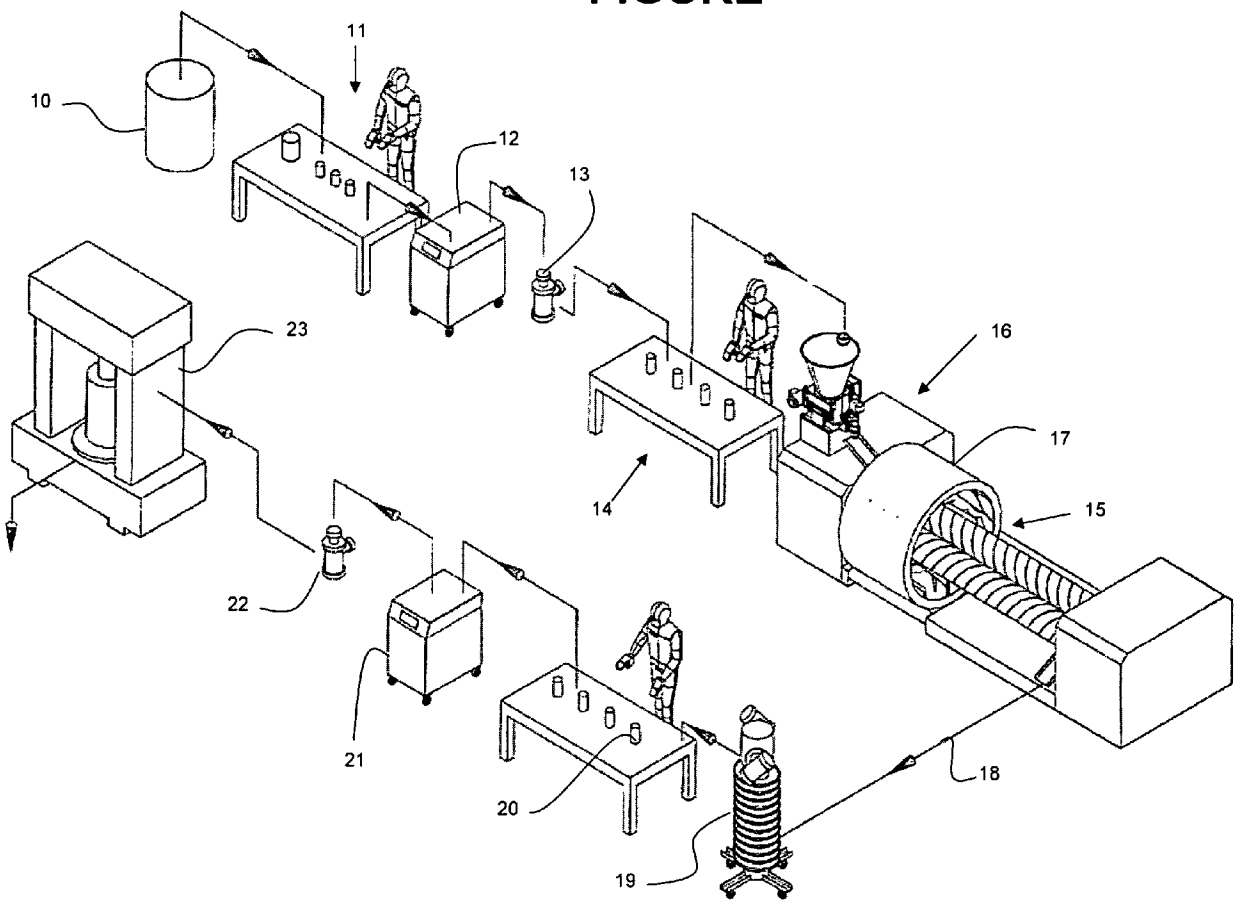

METHOD OF MANUFACTURING EXPLOSIVES

The invention relates to a method of manufacturing explosives.

In the context of the present invention, the term "explosives" refers to potentially explosive and/or explosive substances and material mixtures serving as blasting agents, propellants, igniting agents or pyrotechnic charges or used in their manufacture.

Numerous applications require explosives, and in particular propellant charge powder; examples of such applications include blasting technology and the propelling of projectiles. It is thereby usually necessary for the explosive to be in a specific, variably-sized cube-like or compact form, for example as a powder or a granulate, whereby the explosiveness of the e.g. nitrocellulose and/or nitroglycerin-based raw explosive does, however, pose special problems as far as its processing.

Thus, in the manufacturing of propellant charge powder, a differentiation is essentially made between processes which use solvents and those which do not.

In the manufacturing of solvent-free propellant charge powder (POL powder), one conventional processing method starts with a humidified nitrocellulose/nitroglycerin mixture which is dehydrated and gelatinized on heated rolling mills. This is a manual or semi-automated process using very complex equipment, whereby a sheet is produced at the end of the rolling process which is then spooled and extruded to its desired geometry in a hydraulic press.

In contrast to the above, U.S. Pat. No. 4,963,296, or its corresponding EP 0 288 505 B1 or DE 36 35 296 A1, discloses a method of manufacturing propellant charge powder in a solvent-free process in which a shearing roller processes the humidified raw powder mixture at an elevated temperature. The raw powder mixture is thereby supplied continuously, continuously removed at the end of the shearing roller as a gelatinized mass, and immediately thereafter continuously granulated. The resulting granulate is then continuously fed to an extruder, by means of which it is molded into strands of powder which are processed into the finished powder by cutting or other finishing process.

With respect to the dehydrating and gelatinizing, this method represents a considerable improvement over the initially mentioned POL process, whereby processing the granulates in an extruder has to date not yet been able to be reliably ensured since high melt pressures develop in the press when the granulate is being compacted, which is coupled with considerable safety-related concerns and problems. In order to counteract this, the granulate was therefore mixed with original humidified raw material and only afterwards rolled out into a sheet at a roller and processed. The spooling and the compressing into a desired geometry ensues pursuant the above-described conventional method.

Aside from the complicated operation, the latter method also poses considerable problems. The produced coil exhibits inhomogeneities due to fluctuating or poor gelatinized quality of the raw, previously dehydrated and gelatinized or damp materials mixed together. This has a noticeable negative effect on the overall quality such that most propellant charge powders are still being manufactured by the initially-cited conventional roller method.

A further improvement was achieved by the method described in WO 03/035580. According to this method, immediately after granulation in a shearing unit and subsequent processing into a granulate, the explosive material is formed into a block by means of an isostatic press. Because the granulate is fed to the isostatic press while still in a warm and plastic state, this prevents cooled or hardened granulates from bumping into one another in the press and from safety-related high pressure areas developing at the contact surfaces or the walls of the press during the compressing.

Yet even the cited methods still have difficulties in processing many various raw explosive materials. These difficulties can in part be attributed to the initial adhesion of the raw material to the shearing roller being too low to achieve a continuous and complete plasticizing of the explosive when processing the raw explosive material in a shearing unit. This insufficient initial adhesion prevents many compounds from being processed on a continuous shearing roller. Processing on conventional rollers often also causes great difficulties when processing in batches. In order to achieve sufficient gelatinization, long processing times and/or complex shearing equipment is often necessary, which is highly disadvantageous both in terms of the process costs as well as the safety of realizing the process.

The present invention is thus based on providing a method of manufacturing explosives which can be realized faster and more economically than the methods known in the prior art and which also exhibits a broader applicability respective the explosive compounds utilized.

An important point of the invention is having the raw explosive (10) first be subjected to isostatic pressing prior (13) to gelatinization.

It has been shown that isostatic presses (13) affect gelation properties, particularly of nitro-celluloses. It is thereby apparent that thermo-induced gels clearly differ from pressure-induced gels in their physical and structural properties. In particular, pressure-induced gels exhibit a lower modulus of elasticity, which facilitates later extrusion. Isostatic pressing (13) of raw explosive (10) thus yields a certain gelatinizing of the raw explosive, which clearly improves the processability of the raw explosive processed in this way.

SEM images of raw explosive material containing nitrocellulose confirm that there is a great increase in volume of the nitrocellulose fibers subsequent the isostatic pressing step (13). This swelling suggests that the gelling agent is already dispersed between the polymer chains. The gelling agent partially dissolves the chain association. The apparent cross-linking is loosened. A further loosening then occurs during the subsequent processing, which typically takes place with shearing action (15).

In a preferred embodiment, the isostatic pressing (13) occurs at a pressure of from 1 to 10000 bar, in particular from 1000 to 7500 bar.

It is also preferred to effect the isostatic pressing (13) at a higher temperature than the ambient temperature. Apart from the pressure-induced gelation, doing so also effects a thermo-induced gelation, which improves the pre-plasticizing of the raw explosive. The isostatic pressing (13) preferably occurs at a temperature between 30 to 100° C., in particular between 50 to 90° C.

In order to obtain particularly good results, the raw explosive material (10) should undergo isostatic pressing (13) for a certain dwell time after packing (11) and being subjected to a vacuum (12). Dwell times of from 1 to 20 minutes, particularly 5 to 10 minutes, have proven especially advantageous.

In one preferred embodiment, the post-isostatic press gelatinizing of the raw explosive (10) occurs after foil removal (14) in a gelation device (16) comprising a shearing roller (15) at a temperature ranging from 30° C. to 130° C., preferably at a temperature in the range of 50° C. to 110° C., and particularly preferred in the range of 70° C. to 95° C.

To be understood as a shearing roller (15) in the sense of the invention is a roller as is described in detail in DE 3536295 A1.

The swelling effected by the isostatic pressing of the raw explosive (10) clearly improves the initial adhesion of the raw explosive to the shearing roller (15) when being processed on such a shearing roller, which clearly improves gelation on the shearing roller (15).

In order to improve the processability of the pretreated raw explosive (10) in the gelation device (16), the gelation device (16) of a preferred embodiment comprises a rotating drum (17) with internal lifting fittings on the inside of the drum (17) and internal reverse-conveying fittings at the exit of the drum. The internal lifting fittings inside the drum (17) cause raw explosive material which does not immediately adhere, falling away, to be automatically re-applied. The reverse-conveying internal fittings at the exit of the drum prevent the material from exiting.

In an alternative embodiment, the gelation of the raw explosive by means of a gelation device (16) comprising a roller (15) occurs at a temperature ranging from 30° C. to 130° C., preferably at a temperature in the range of 50° C. to 110° C., and particularly preferred in the range of 70° C. to 95° C.

The warm explosive body yielded by the isostatic pressing exhibits an elasticity which is highly advantageous for its further processing. It is thus preferred for the explosive body produced by the isostatic pressing (13) to immediately undergo the subsequent gelling process without any interim cooling.

The further processing of the gelatinized explosive can be effected as described for example in WO 03/035580. A typical procedure through to the final product is depicted in the process diagram attached as the FIGURE.

A preferred embodiment of the explosive particularly provides for immediate granulating (19) after exiting the gelation device and the granulate (18) being immediately packed (20), subjected to a vacuum (21), and formed into a block (19) after granulating by means of an isostatic press (22). It is hereby preferred for the granulate to be fed to the isostatic press (22) in a warm, in particular plastic state. The ensuing block can then be processed further in conventional manner, in particular by means of a hydraulic press (23).

In one preferred embodiment, the raw explosive comprises at least one gelatinizable component and at least one gelating component.

The gelatinizable component of the raw explosive preferably contains nitrocellulose. The raw explosive can however also contain gelatinizable components which in themselves are not explosive. Cellulose acetate is one such example of a gelatinizable component.

The gelating component of the raw explosive preferably contains nitroglycerin and/or ethylene glycol dinitrate and/or nitramine. The raw explosive can however also contain gelating components which in themselves are not explosive. Examples of such gelating components are typical plasticizers such as e.g. phthalates.

The raw explosive can also contain explosives which are neither gelatinizable nor gelating. Examples of such explosives are RDX, HMX, PETN and nitroguanidine.

A particularly advantageous explosive to be employed in the inventive method contains one or more of the following components: nitrocellulose, nitroglycerin, ethylene glycol dinitrate, one or more nitramines, RDX, nitroguanidines.

In one preferred embodiment, a humidified solvent-free raw explosive is used as the raw explosive material.

In an alternative embodiment, a solvent-dampened raw explosive is used as the raw explosive material. The solvent-dampened raw explosive preferably contains acetone, diethyl ether, ethanol or mixtures of the cited solvents.

In one embodiment, the raw explosive contains carbon in the form of carbon black or graphite, in particular at a volume of from 0.1 to 1.0 wt. %.

In a particularly preferred embodiment, the raw explosive contains carbon nanotubes, in particular at a volume of from 0.05 to 1.0 wt. %.

In addition to graphite, diamond and fullerenes, carbon nanotubes constitute an allotopic modification of carbon. In carbon nanotubes, graphite lattices are disposed in tubular form and capped on their ends by a fullerene half-cap structure.

The incorporating of carbon nanotubes leads to the following advantages for the explosives:

- Achieving an electrical conductivity or electrostatic dissipation (anti-static) in the otherwise insulating explosives
- Improving the mechanical properties, in particular as regards stability
- Increasing the thermal conductivity and the thermal stability of the explosives It has been shown that the inventive method is coupled with a number of advantages. As described above, isostatic pressing effects a gelling of the raw explosive material. This leads to clearly simplifying the subsequent post-gelation processing. Employing a shearing roller to effect gelling has in particular been shown to greatly improve the initial adhesion of the raw explosive to the roller as well as the heat transfer from the roller to the isostatically compressed raw explosive material. This enables less complex shearing devices to be used as well as shortens the process times, which leads to lower equipment costs and higher through-put. Shown to be an additional advantage is that the lower thermal loads on the material yielded by the shorter process times leads to increased long-term stability of the final product.

With respect to the simplifying of the shearing device, it has been shown that the better processing properties of the raw explosive material pre-treated by isostatic pressing enables the use of shorter shearing rollers, which in addition to lowering the equipment costs, also has the additional advantage of lower roller deflection, which manifests itself in less wear on the shearing device and increased process safety when processing raw explosive materials.

A further surprising advantage of the method according to the invention comprises the potential of processing raw explosives which could not be processed, or only with great difficulty, according to prior methods. For instance, pursuant the prior methods, raw nitro-cellulose and nitroglycerin/ethylene glycol dinitrate-based explosives could only be processed for certain compounds when the nitrocellulose had a specific nitrogen content (degree of nitration). Outside of this "window," conventional methods cannot effect gelation of the raw explosive. With the preceding step of isostatic pressing, the inventive method also enables the gelation of such raw explosives outside of this window. This considerably increases the flexibility of the procedure in terms of using nitrocellulose of differing nitrogen contents.

The following will draw on embodiments, illustrated by means of images, in describing in the invention in greater detail.

EXAMPLE 1

SEM Image Analysis of an Explosive Material Treated by Means of Isostatic Pressing A raw nitrocellulose/nitroglycerin explosive material underwent isostatic pressing for 5 minutes at 80° C. and 3500 bar.

Samples of the raw explosive material were taken prior to and subsequent the isostatic pressing and were thereafter analyzed using a scanning electron microscope.

EXAMPLE 2

Manufacturing an Explosive

A raw explosive material (37% nitrocellulose, 37% nitroglycerin, 1% Centralit, 25% RDX) is filled into a polyethylene tube. After evacuating the tube, it was sealed and inserted into the isostatic press. The temperature of the hydraulic fluid was at 85° C., the pressure applied was 5000 bar and the dwell time was 8 minutes. After extracting and removing from the mold, the formed body was dispensed to a shearing roller via a heated comminution/metering device such that no cooling occurred.

It was shown that the raw explosive material pretreated by isostatic pressing as described above exhibits excellent properties for its further processing on the shearing roller.

The invention claimed is:

1. A method of manufacturing explosives from a raw explosive material comprising:

isostatic pressing the raw explosive; and then gelatinizing the raw explosive.

2. The method according to claim 1, wherein the isostatic pressing occurs at a pressure of from 1 to 10000 bar.

3. The method according to claim 1, wherein the isostatic pressing occurs at a temperature of between 30° C. and 100° C.

4. The method according to claim 1, wherein the isostatic pressing is performed for a period of time lasting from 1 to 20 minutes.

5. The method according to claim 1, wherein the gelatinizing of the raw explosive is carried out by a gelation device comprising a shearing roller, at a temperature ranging from 30° C. to 130° C.

6. The method according to claim 5, wherein, in addition to a shearing roller, the gelation device comprises a rotating drum with internal lifting fittings and internal reverse-conveying fittings at an exit of the drum.

7. The method according to claim 1, wherein the gelation of the raw explosive by a gelation device comprising a roller, occurs at a temperature ranging from 30° C. to 130° C.

8. The method according to claim 5, wherein subsequent to the isostatic pressing, the raw explosive is introduced to the gelling device via a heated comminution/metering device essentially without interim cooling of the raw explosive.

9. The method according to claim 1, wherein the raw explosive comprises at least one gelatinizable component and at least one gelating component.

10. The method according to claim 1, wherein a humidified solvent-free raw explosive is used as the raw explosive material.

11. The method according to claim 1, wherein solvent-dampened raw explosive is used as the raw explosive material.

12. The method according to claim 11, wherein the solvent-dampened raw explosive contains acetone, diethyl ether, ethanol or mixtures of the cited solvents.

13. The method according to claim 1, wherein the raw explosive contains carbon in the form of carbon black or graphite at a volume of from 0.1 to 1.0 wt. %.

14. The method according to claim 1, wherein the raw explosive contains carbon nanotubes at a volume of from 0.05 to 1.0 wt. %.

15. The method according to claim 2, wherein the isostatic pressing occurs at a pressure of from 1000 to 7500 bar.

16. The method according to claim 3, wherein the isostatic pressing occurs at a temperature of between 50° C. and 90° C.

17. The method according to claim 4, wherein the isostatic pressing is performed for a period of time lasting from 5 to 10 minutes.

18. The method according to claim 5, wherein the gelatinizing of the raw explosive is carried out by a gelation device comprising a shearing roller, at a temperature ranging from 50° C. to 110° C.

19. The method according to claim 5, wherein the gelatinizing of the new explosive is carried out by a gelation device comprising a shearing roller, at a temperature ranging from 70° C. to 95° C.

20. The method according to claim 7, wherein the gelatinizing of the new explosive is carried out by a gelation device comprising a roller, occurs at a temperature ranging from 50° C. to 110° C.

21. The method according to claim 7, wherein the gelatinizing of the new explosive is carried out by a gelation device comprising a roller, occurs at a temperature ranging from 70° C. to 95° C.

* * * * *